United States Patent [19]

Witberg

[11] 4,116,100

[45] Sep. 26, 1978

[54] DEVICE FOR FASTENING CUTTING DIES ON A BASE PLATE

[75] Inventor: Martinus Johannes Joseph Witberg, Breda, Netherlands

[73] Assignee: Sandvik Aktiebolag, Sandviken, Sweden

[21] Appl. No.: 771,376

[22] Filed: Feb. 23, 1977

[30] Foreign Application Priority Data

Feb. 24, 1976 [SE] Sweden ..... 7602191

[51] Int. Cl.[2] ..... B26F 1/44

[52] U.S. Cl. ..... 83/698; 83/669

[58] Field of Search ..... 83/346, 347, 665, 669, 83/670, 673, 674, 675, 698, 699, 700; 76/107 C

[56] References Cited

U.S. PATENT DOCUMENTS

| | | | |
|---|---|---|---|
| 3,119,312 | 1/1964 | Henc | 83/665 X |
| 3,170,358 | 2/1965 | Martin | 83/673 |
| 3,188,900 | 6/1965 | Mauro | 83/698 X |
| 3,529,506 | 9/1970 | Malm | 83/698 |
| 3,616,720 | 11/1971 | Larson | 83/698 X |
| 3,645,155 | 2/1972 | Robinson | 83/698 X |
| 3,739,676 | 6/1973 | Gerdin | 83/698 |
| 3,792,637 | 2/1974 | Saunders | 83/346 X |

*Primary Examiner*—J. M. Meister

*Attorney, Agent, or Firm*—Burns, Doane, Swecker & Mathis

[57] ABSTRACT

For fastening a cutting die on a base plate, the device of the invention comprises clamps insertable in recesses provided in the die, the lower part of the die being received in a slot in the base plate. The clamps are composed of bridge elements, and the recesses in the die are keyhole-shaped and open downwards.

14 Claims, 4 Drawing Figures

DEVICE FOR FASTENING CUTTING DIES ON A BASE PLATE

This invention relates to the die cutter art, and is concerned with an improved mode of fastening a cutting die to a base plate.

Known cutting dies do not make a good punching of thin material. This circumstance, which is particularly observable if the material is lying on a hard bed, is due partly to the fact that the vertical unevenness of the dies is of the same size as the thickness of the material and partly that the fastening elements do not neutralize the vertical unevenness of the dies.

An object of this invention is to eliminate the above-mentioned drawback by arranging the fastening of the dies in such a way that the differences in the vertical sizes of the dies are neutralized.

Another inventive object is to provide such fastening elements for the dies that the exchange of worn and damaged dies will be both easy and quick. Moreover, the lateral guiding of the dies will be good, — which is of great importance, — and the vertical elasticity of the dies can easily be regulated.

Other objects of the invention will be apparent from the following description, when read in connection with the accompanying drawing, in which.

Figure 1:
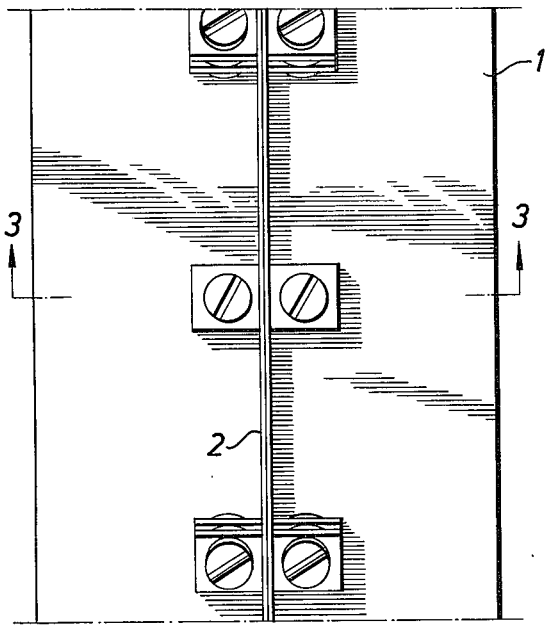
FIG. 1 is a top plan view of a cutting die being fastened to a base plate.
Figure 2:
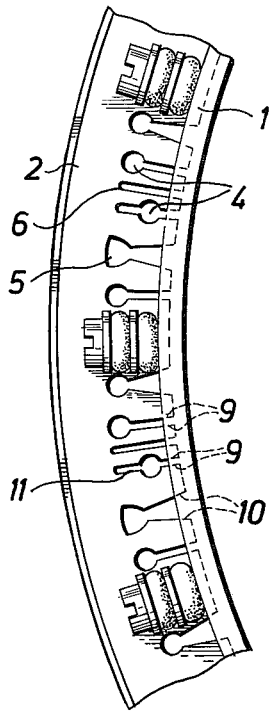
FIG. 2 is a side view of the die and the base plate shown in FIG. 1.
Figure 3:
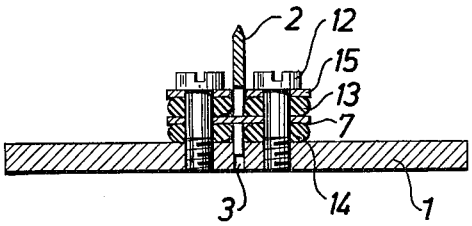
FIG. 3 is a section along the line 3—3 of FIG. 1.
Figure 4:
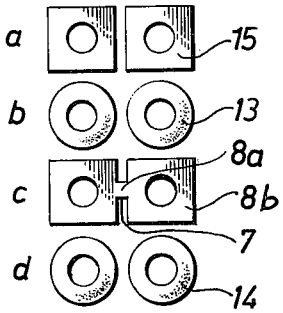

FIG. 4*a*—*d* are details of the device according to FIG. 3.

Referring now to the drawing, there is shown a base plate 1 in which the die 2, made of strip steel, is inserted into slots 3 having a width that is inconsiderably greater than the thickness of the die 2. This die can be composed of one or several bent parts to correspond to the contour of the article being punched out, or of a number of straight independent parts. The base plate 1 has such a thickness that the die neither unloaded nor in operation reaches the underside of the base plate. In the die there have been made keyhole-shaped recesses or apertures 4, 5 between which other recesses or apertures 6 with straight slots can exist in order to facilitate the longitudinal bending of the die. The recesses 4, 5 being open downwards are provided with an enlarged upper part which surrounds a bridge element 7, made of metal or another suitable material, and which joins two washers **8*b* with each other by a bridge 8*a*. The form of the recesses 4, 5 is such that the bridge element 7 can only be inserted into or removed from the recesses on edge, i.e. in vertical position. The bridge element 7 is fixed in the enlarged, upper part of the recess 4, 5 by turning it 90° so that it assumes a horizontal position. In order to give the bridge element 7 a secure fixation vertically the enlarged upper part of the recess can be given the form of a circle 4 or a triangle with curving sides 5. The lower slot-formed part of the recess 4, 5 can have parallel sides 9 or, when such a die is intended for cylindrical base plates, sides 10** with a distance from each other increasing downwards so that even after bending of the dies the whole slot permits insertion of the bridge element.

Washers **8*b* of the bridge element 7 are fastened to the base plate 1 by means of fastening elements 12, which can be composed of screws, rivets or nails. Vertical elasticity is achieved by resilient washers 13, 14 of rubber or another suitable material, which washers are mounted on the two sides of the bridge element. If the fastening elements 12 have small heads washers 15 of suitable material such for instance as metal can be mounted between the heads of the fastening elements and the resilient washers 13. The resilience constant of the washers 13, 14 can be regulated by changing the tightening of the fastening elements 12**, or by choosing material with different thickness and hardness. The vertical elasticity of the die can also be regulated by changing the distance between the bridge elements in order to prevent the vertical movement of the die from becoming so great that it reaches the underside of the base plate.

The recess of the die can be extended with a narrow part 11 above that part 4 which surrounds the bridge element 7. The object of this is to facilitate the bending of the die in a case when the distance between the bridge element and the edge shall be great, — for instance, if the heads of the fastening elements are big or if the resilient washers are thick.

The length of the bridge **8*a* shall be so great that the dies does not press against the washers 8*b***. In special cases the bridge elements can be made longer than usual to be used when two dies are mounted side by side.

While a particular embodiment of the present invention has been illustrated and described herein, it is to be understood that it is not intended to limit the invention to such disclosure but changes and modifications may be made therein within the scope of the following claims.

I claim:

1. A cutting die assembly comprising:

a cutting die including a body portion defining a plane and having an upper cutting edge located substantially in said plane, and a lower part located substantially in said plane;

apertures provided in said body portion of said die;

a base plate having a slot removably receiving said lower part of said die; and means for fastening the die to the base plate comprising a plurality of clamp members removably received in respective ones of said apertures for engagement with the die body, said clamp members extending laterally through said apertures above said base plate; and fastening elements extending into said base plate for releasably securing said clamp members to said base plate such that, in response to release of said fastening elements, said die is removable from said base plate and said clamp members are freely removable from said die apertures.

2. An assembly according to claim 1, wherein said die apertures are keyhole-shaped and open downwards.

3. An assembly according to claim 2, wherein said apertures have an enlarged upper part.

4. An assembly according to claim 3, wherein said apertures each include a narrow part extending above the enlarged upper part.

5. An assembly according to claim 2, wherein lower slot-shaped parts of the recesses have parallel sides.

6. An assembly according to claim 2, wherein lower slot-shaped parts of the recesses are formed by sides which diverge downwardly.

7. An assembly according to claim 2, wherein each clamp member comprises two washer-like elements connected to each other by a bridge forming an intermediate portion, the clamp element being formed integrally of rigid material.

8. An assembly according to claim 7, wherein the width of the bridge is materially greater than is its thickness, so that the clamp member can be inserted into the aperture only on edge.

9. An assembly according to claim 1, wherein the assembly is provided with further apertures in addition to those arranged for insertion of clamp members, said further apertures having parallel sides.

10. An assembly according to claim 1, wherein the die is elastically fastened to the base plate for movement of said cutting edge toward said base plate, with said lower part being slidable in said slot to accommodate such movement.

11. An assembly according to claim 10, wherein the fastening elements have heads located above said clamp members and wherein resilient elements are disposed between the clamp members and the base plate.

12. An assembly according to claim 11, wherein said resilient elements are annular in form and are made of rubber.

13. An assembly according to claim 10, wherein said lower part is coplanar with said body portion, said base plate has such a thickness and the resilient elements such a form that the lower part of the die does not reach the underside of the base plate when the die is unloaded or loaded.

14. An assembly according to claim 1, wherein said fastening elements are screws.

* * * * *